US005964611A

United States Patent [19]

Jacob et al.

[11] Patent Number: 5,964,611

[45] Date of Patent: Oct. 12, 1999

[54] INTEGRATED CABLE MANAGER AND CIRCUIT PACK/MODULE LATCH

[75] Inventors: Michal Karin Jacob, Ottawa; Floyd James Pushelberg, Nepean; Mark Justin Sonderegger, Gloucester, all of Canada

[73] Assignee: Nortel Networks Corporation, Montreal, Canada

[21] Appl. No.: 09/092,850

[22] Filed: Jun. 8, 1998

[51] Int. Cl.[6] ..... H01R 13/62

[52] U.S. Cl. ..... 439/372; 439/942

[58] Field of Search ..... 439/540.1, 144, 439/716, 717, 701, 942.1, 924.2, 372, 157, 445, 449, 942

[56] References Cited

U.S. PATENT DOCUMENTS

| | | | |
|---|---|---|---|
| 4,840,574 | 6/1989 | Mills | 439/372 |
| 4,995,821 | 2/1991 | Casey | 439/372 |
| 4,998,884 | 3/1991 | Ishikawa et al. | 439/372 |
| 5,391,086 | 2/1995 | Woller et al. | 439/372 |
| 5,873,745 | 2/1999 | Duclos et al. | 439/372 |

*Primary Examiner*—Michael L. Gellner
*Assistant Examiner*—Antoine Ngandjui

[57] ABSTRACT

A latch/cable management unit (LCM) provides a handle to push or pull a faceplate of a circuit pack or module into or out of a cabinet designed to house circuit modules. The LCM is also designed to contain and route cables or fibres extending from the faceplate. The LCM is pivotally connected to one end of the faceplate, pivotable in a plane parallel to an axis of the faceplate from a closed to an open position. The LCM has two arms which form a gap for containing the cables. Upper portions of the arms form an entrance/exit to allow passage of the cables or fibres into and out of the gap. The LCM also has a securing bar which locks the faceplate into the cabinet when the LCM is rotated into the closed position. The LCM also has means to hold the LCM in either the open position or the closed position to prevent inadvertent rotation of the LCM. Typically, the LCM will be used in combination with a latch located at another end of the faceplate to help move the faceplate into or out of the cabinet.

20 Claims, 6 Drawing Sheets

INTEGRATED CABLE MANAGER AND CIRCUIT PACK/MODULE LATCH

FIELD OF THE INVENTION

The invention relates to circuit modules and is particularly concerned with cable management and latches for circuit modules.

BACKGROUND OF THE INVENTION

Typically, when a number of circuit boards are to be housed parallel to each other, each circuit board is housed in a circuit module (or pack) and the modules are housed parallel to each other in a cabinet. A rear surface of each module has one or more connectors to connect with protruding pins on a backplane. A front surface of each module has a faceplate, which acts as an interface between the circuit board and cables or fibres to be connected to the circuit board.

In order to be able to slide each module in and out of the cabinet, latches may be provided, which, if present, are typically pivotally connected to the faceplate, are used to help the user pull or push a module into or out of the cabinet.

For cable management purposes, it is also known to have a row of cable management pieces, the row oriented transverse to the axis of the faceplates and located on a surface of the cabinet, adjacent the faceplates of the modules. Each cable management piece is designed to hold or direct one or more cables or fibres extending from an adjacent faceplate. Typically, if the cabinet accommodates ten modules, for example, there would be a row of ten cable management pieces, one piece adjacent to each faceplate. In one known design, the row is manufactured out of a single piece of plastic, adhered to the cabinet. Accordingly, if a single module in a cabinet having one size cable were replaced with another module having a different size cable, it would not be convenient to replace the cable management piece corresponding to that module, because all of the cable management pieces for that cabinet would have to be replaced.

In view of the above, each faceplate may have associated with it two latches and one cable management piece. It would be desirable for reasons of simplicity, cost and maintenance, to reduce the number of such components (ie: to fewer than two latches and one cable management piece).

SUMMARY OF THE INVENTION

It is an object of the invention to obviate or mitigate one or more of the above identified disadvantages.

According to a first broad aspect, the invention provides an elongate faceplate for a circuit module receivable within a cabinet, the faceplate having a longitudinal axis, at least one aperture for receiving a first connector mounted on the module which connector is mateable with a second connector connected to a cable, the faceplate having at one longitudinal end a latch member engageable with a part of the cabinet to latch the faceplate to the cabinet, the faceplate having at the other longitudinal end a latch/cable management unit (LCM) and an LCM end surface perpendicular to the longitudinal axis of the faceplate, the LCM comprising: a cable containment means for containing the cable connected to the second connector; and an integral latching member engageable with a part of the cabinet, the LCM being pivotably mounted about an axis perpendicular to the longitudinal axis such that when the LCM is manually pivoted from a relatively open position to a relatively closed position the integral latching member latches to the cabinet.

According to another broad aspect the invention provides the faceplate of claim 1 wherein the containment means move towards the latch member as the LCM is pivoted from the open position to the closed position and the containment means move away from the latch member as the LCM is pivoted from the closed position to the open position.

There are several advantages to the present invention. The most obvious advantage is that one component (ie: one latch/cable management unit) replaces two (one separate latch and one separate cable management unit). Fewer components typically translates into reduced manufacturing costs and a corresponding need for fewer spare replacement parts. The reduction from two components to one component also reduces the space required around the front end of the module. The module is therefore more likely to fit in constricted spaces. The invention also enables easier customization of cable management units. Because each module has its own latch/cable management unit attached, if one module having large gauge cables is replaced with a module having small gauge cables, for example, the latch/cable management unit relating to that one module can be replaced to provide tighter cable management without having to replace the cable management units for all of the modules.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
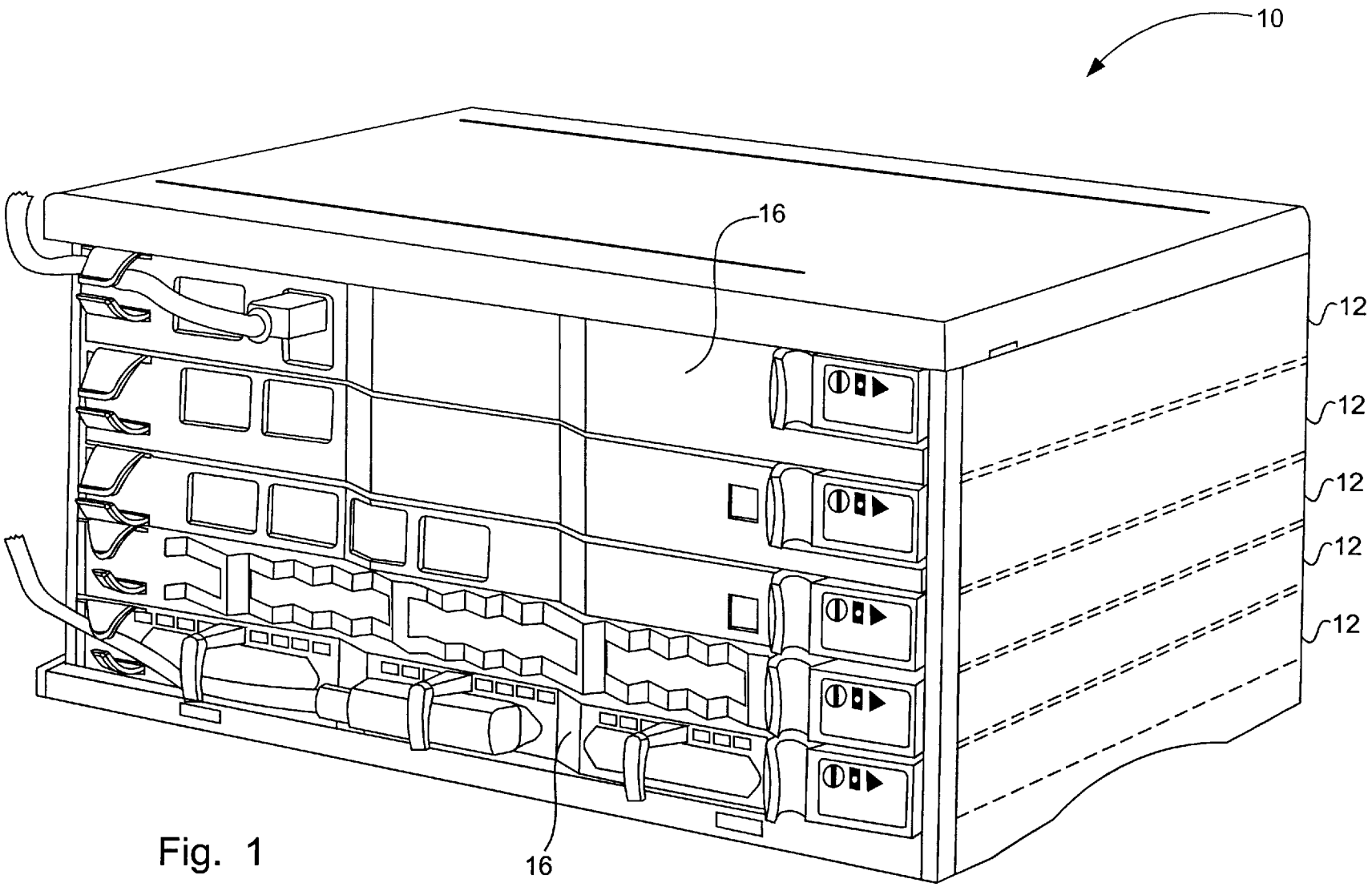
FIG. 1 is a perspective view of a number of circuit modules housed within a cabinet, each module, shown by dotted lines, has having a faceplate incorporating a latch/cable management (LCM) unit according to one embodiment of the invention.

As shown in FIG. 1, a cabinet 10 houses a number of circuit modules or packs 12 oriented parallel to each other. Each circuit module 12 encloses a circuit board (not shown). A rear surface (not shown) of each module 12 has connectors (not shown) for engagement with pins (not shown) protruding from a backplane (not shown). An elongate faceplate 16 covers the front surface of each module 12.

The faceplate 16 will now be described with reference to FIGS. 2*a*–2*c*, which are perspective views of the faceplate 16. Each faceplate 16 has a rear surface 19, a latch (or latch member) 18 pivotally connected to the faceplate 16 near the rear surface 19, a forward surface (or LCM end surface) 21, and latch/cable management (hereinafter "LCM" or "LCM unit") unit 20 pivotally connected to the faceplate 16 near the forward surface 21. The faceplate 16 also has one or more apertures 22 to permit engagement of cable connectors 24 (see FIG. 2*c*) to the printed circuit board (not shown). The faceplate 16 shown in FIGS. 2*a*–2*c* has a staggered arrangement, with each aperture 22 located on a different staggered level.

The LCM unit 20 will now be described with reference to FIGS. 3*a*–3*c*, which show front perspective, rear perspective and bottom perspective views, respectively, of the LCM unit 20 shown in FIG. 2*c*. The LCM 20 shown in FIGS. 2*a* and 2*b* are smaller than the LCM 20 shown in FIGS. 2*c* and 3*a*–3*c*, as will be discussed below. The LCM unit 20 is preferably made of a strong yet somewhat flexible plastic such as polycarbonate ABS.

The LCM unit 20 has a front wall 30 interconnecting two spaced-apart side walls 32, 34. A gap 35, of generally oval shape, is formed within the front wall 30. Upper portions of walls 32, 34 form arms 36, 38. The upper extremities of walls 36, 38 have curved portions 40, 42, which curve towards each other, but preferably do not meet, leaving an entrance/exit 46 (to/from gap 35) between the curved portions 40, 42.

Figures 3A, 3B, 3C:
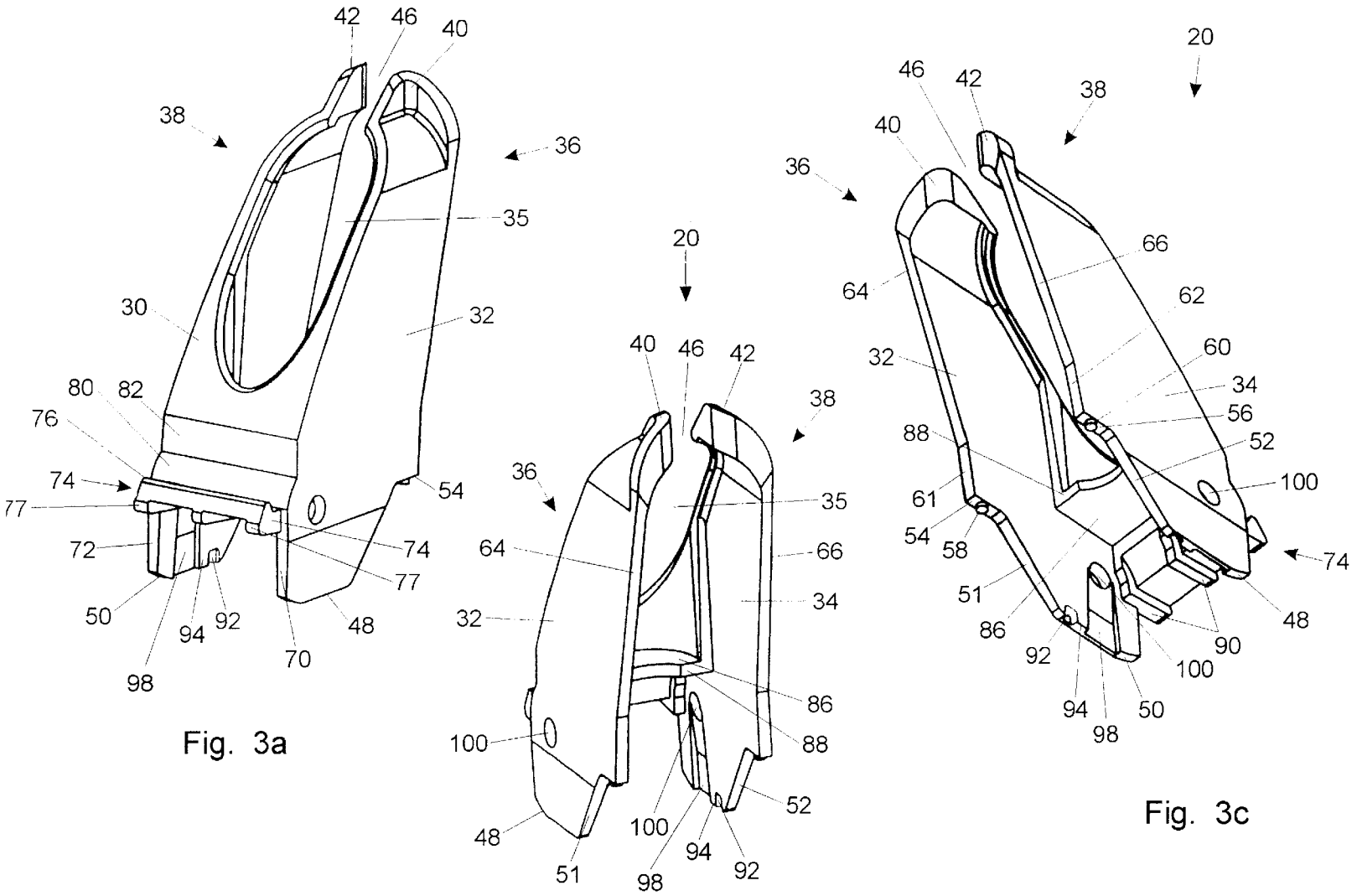
FIGS. 3*a*, 3*b* and 3*c* are front perspective, rear perspective and bottom perspective views of the LCM of FIG. 2*c*.

The walls 32, 34 have bottom surfaces 48, 50 and rear facing surfaces 51, 52, 54, 56, 61, 62, 64, 66 as shown in FIGS. 3*b* and 3*c* and as described below. The bottom surfaces 48, 50 of walls 32, 34 are relatively flat. With respect to the surfaces of walls 32, 34 facing rearwardly (best seen in FIGS. 3*b* and 3*c*), angled surfaces 51, 52 are located adjacent to bottom surfaces 48, 50. Extending rearwardly from angled surfaces 51, 52 are stop surfaces 54, 56 which are generally parallel to bottom surfaces 48, 50. Stops 58, 60 project downwardly from stop surfaces 54, 56. Extending upwardly and generally perpendicularly from stop surfaces 54, 56 are flat surfaces 61, 62. Extending upwardly and slightly rearwardly from flat surfaces 61, 62 are rear surfaces 64, 66.

The walls 32, 34 have forward facing surfaces 30, 70, 72, 74, 77, 80, 82 as shown in FIG. 3a and as described below. Lower-forward surfaces 70, 72 are adjacent and generally perpendicular to bottom surfaces 48, 50. Extending generally outwardly or perpendicularly from an upper portion of lower-forward surfaces 70, 72 is a securing bar (or integral latching member) 74. Securing bar 74 has a flat portion 74 adjacent and perpendicular to the upper portion of the lower-forward surfaces 70, 72. The securing bar 74 has an upwardly projecting ridge 76 remote from lower-forward surfaces 70, 72. The securing bar 74 also has an outermost surface 77.

A lower surface 80 of front wall 30, which extends upwardly above securing bar 74, preferably curves upwardly and rearwardly. A vertical portion 82 extends upwardly from the lower surface 80 and is preferably generally vertical when the LCM unit 20 is in the orientation shown in FIG. 3*a*.

The main features of interior surfaces of the LCM 20 will now be described primarily with reference to FIGS. 3*b* and 3*c*. As shown in FIGS. 3*b* and 3*c*, the interior of the LCM is generally hollow, and the interior surfaces of the LCM 20 generally conform to the shape of the outer surfaces of walls 30, 32 and 34 described above.

Below the gap 35 is a mating wall 86 which projects rearwardly from an inner surface of front wall 30. A rear edge 88 of mating wall 86 is flat near the side walls 32, 34 and generally semi-circular in a mid-portion of edge 88. The shape of edge 88 is designed to mate with a corresponding portion of faceplate 16 and therefore the shape of edge 88 is determined by the shape of the corresponding portion of faceplate 16.

An inner surface and lower surface of securing bar 74 have support ridges 90.

The inner surfaces of side walls 32, 34 each has an indentation 92 adjacent bottom surfaces 48, 50 and near angled surfaces 51, 52. A detent portion 94 is adjacent indentation 92, with detent portion 94 being angled (not shown) towards the indentation 92.

The inner surface of each of side walls 32, 34 has a depression 98 extending from bottom surfaces 48, 50 upwards and terminating at a pivot hole 100. Pivot holes 100 are preferably located around the level of securing bar 74. Pivot holes 100 preferably extend from the inner surfaces of walls 32, 34 to the outer surfaces of walls 32, 34 but need not extend to the outer surfaces.

Figure 4:
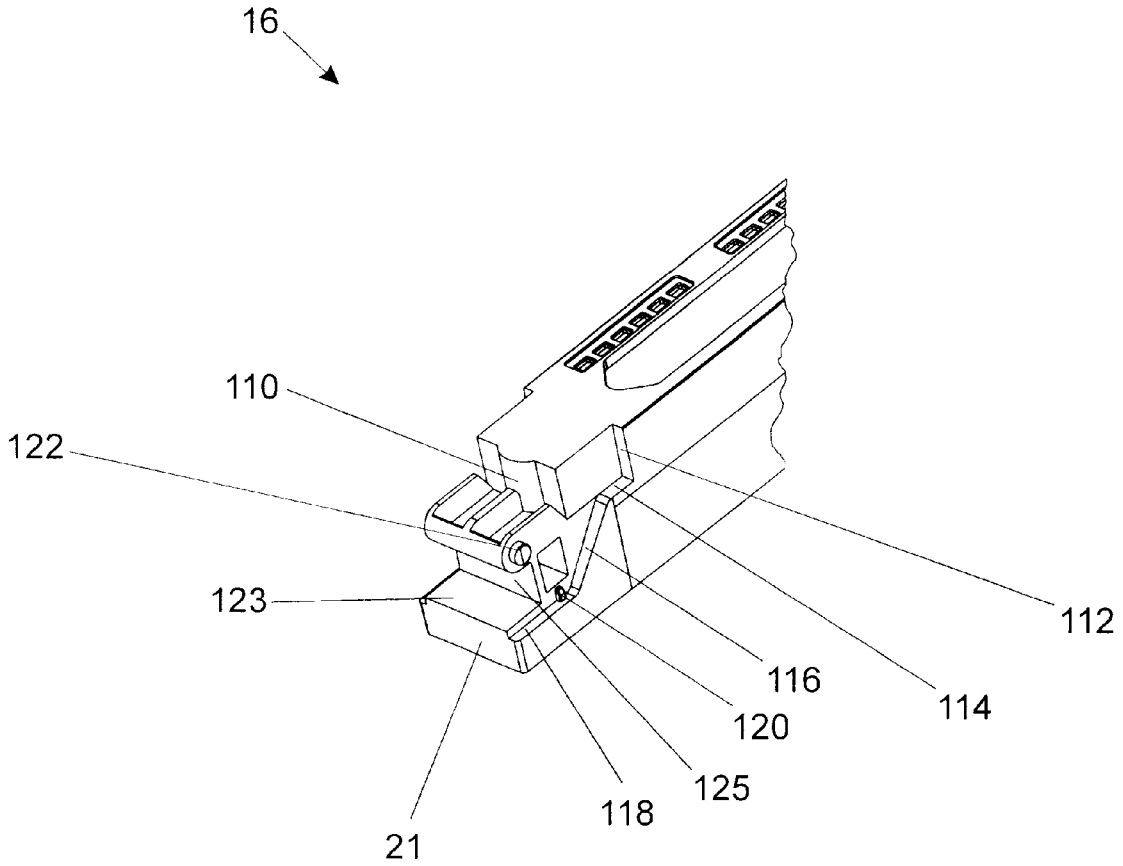
FIG. 4 is a front perspective view of an end of the faceplate of FIG. 2*a* with the LCM removed.

The portions of the faceplate 16 which mate with certain portions of the LCM 20 when the LCM 20 is in the closed position shown in FIG. 2*a* will be described with reference to FIG. 4 which is a perspective view of a portion of the faceplate 16 with the LCM 20 removed. Very generally, edge 88 of the LCM 20 mates with edge 110 of the faceplate 16. Flat surfaces 61, 62 of the LCM 20 mate with surfaces 112 of the faceplate 16 (because of the perspective view of FIG. 4, only one of the two surfaces 112 is visible). Stop surfaces 54, 56 mate with surfaces 114 of the faceplate 16. Angled surfaces 51, 52 of the LCM 20 mate with surfaces 116 of the faceplate 16. Bottom surfaces 48, 50 of the LCM 20 mate with surfaces 118 of the faceplate 16.

Projections 120 of the faceplate 16, which project upwardly from surface 118, mate with indentations 92 of the LCM 20. Pivot holes 100 of the LCM 20 pivotally mate with pivot projections 122 of the faceplate 16.

As the LCM 20 is rotated from the open to the closed position (or vice versa), the outermost surface 77 of the LCM 20 contacts lower surface 123 of the faceplate 16.

When the LCM 20 is in the open position (shown in FIG. 2*b*), the support ridges 90 on the under surface of the securing bar 74 of the LCM 20 mate with stop wall 125 of the faceplate 16 located beneath pivot holes 100.

Figure 2A:
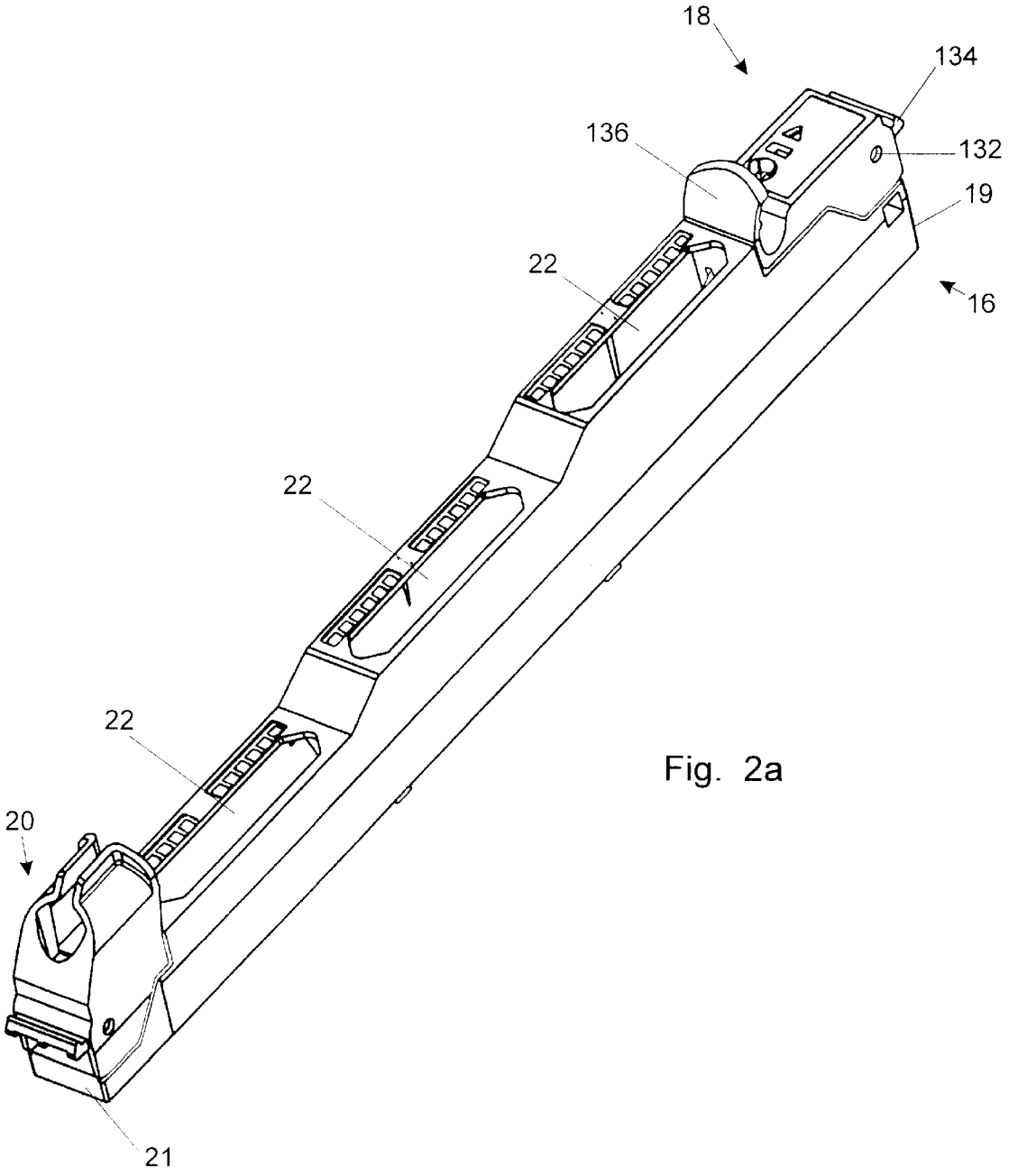
FIG. 2*a* is a perspective view of a faceplate of FIG. 1 with the LCM and the latch in the closed position.

With respect to the latch 18, as shown in FIG. 2*a*, the main elements include finger hold 130, located at one end of latch 18, pivot holes 132 and securing bar 134 located at the other end of latch 18. The latch 18 mates with faceplate 16 in a generally similar fashion as the LCM 20 mates with faceplate 16.

Use of the invention will now be described primarily with reference to FIGS. 1 and 2*a*–2*c*. To insert a module 12 into the cabinet 10, it is necessary for the LCM 20 and the latch 18 to be in the open position shown in FIG. 2*b*. In this position, the user can wrap his or her fingers around the arms 36, 38 of the LCM 20 and the latch 18 to push the module into place. It should be noted that in this open position, the securing bars 74, 134 of the LCM 20 and latch 18, respectively, have been rotated inwardly of surfaces 21 and 19, respectively, of the faceplate 16.

When the module 12 has been almost fully inserted into cabinet 10, the module 12 is secured in the cabinet 10 by rotating the securing bars 74, 134 of the LCM 20 and the latch 18, respectively, outwardly from surfaces 21 and 19, respectively. In other words, in order to fully insert and secure the module 12 to the cabinet 10, from the open position shown in FIG. 2*b*, the LCM 20 is rotated clockwise (ie: the arms 36, 38 of the LCM 20 are rotated towards the faceplate 16) and the latch 18 is rotated counter-clockwise. This method of securing the module 12 also acts to push the module 12 the last millimetre or so into the cabinet 10. More specifically, the LCM 20 is rotated clockwise (ie: pivot holes 100 of the LCM 20 pivot about pivot projections 122 of the faceplate 16) until the stops 58, 60 on the stop surfaces 54, 56 of the LCM 20 come into contact with surface 114 of the faceplate 16, thereby preventing any further rotation in that direction. The latch 18 is similarly rotated (except counter-clockwise) and similarly stopped.

The cabinet 10 is conventional and, as is well known to those skilled in the art, includes flanges adapted to engage conventional latches. When the module 12 has been inserted into the cabinet 10 and the LCM 20 and the latch 18 have been rotated to the closed position as shown in FIG. 2*a* and as described above, the securing bars 74, 134 of the LCM 20 and the latch 18, respectively, hold the module 12 in place as a result of the securing bars 74, 134 engaging flanges (not shown) in the cabinet adjacent to surfaces 21 and 19 of the faceplate 16 when the faceplate 16 is inserted into the cabinet 10.

When the module 12 and the faceplate 16 have been inserted into the cabinet 10 as shown in FIG. 1, a cable connector 24 (FIG. 2*c*) may be inserted into aperture 22 of faceplate 16, thereby creating an interface between the printed circuit board (not shown) housed within module 12 and cable 126.

While the cable connector 24 is engaged within aperture 22, for cable management reasons, it is desirable that cable 126 be contained within gap 35 of the LCM 20. To place cable 126 within gap 35, the cable 126 is pushed between curved portions 40, 42 of the flexible arms 36, 38 through entrance/exit 46 of the LCM 20. The gap 35 is sized to accommodate the number and gauge of cables extending from faceplate 16.

In order to remove module 12 from the cabinet 10, it is necessary to remove cable 126 from gap 35 by pushing the cable 126 upwardly between curved portions 40, 42 of the flexible arms 36, 38 through the entrance/exit 46 of the LCM 20. The cable connector 24 can then be removed from aperture 22 of the faceplate 16. (The cable connector 24 can be removed from aperture 22 either before or after the cable 126 has been removed from gap 35 of the LCM 20.)

To remove the module 12 from the cabinet 10, the LCM 20 and the latch 18 must first be rotated in order to rotate their respective securing bars 74, 134 inwards of surfaces 21, 19, respectively, of the faceplate 16. This rotation releases the securing bars 74, 134 from their locking engagement with the adjacent flanges (not shown) of the cabinet 10. In other words, from the closed position shown in FIG. 2*a*, the LCM 20 is rotated counter-clockwise (ie: the arms 36, 38 of the LCM 20 are rotated away from the latch 18) and the latch 18 is rotated clockwise to the open position shown in FIG. 2*b*.

Figure 2B:
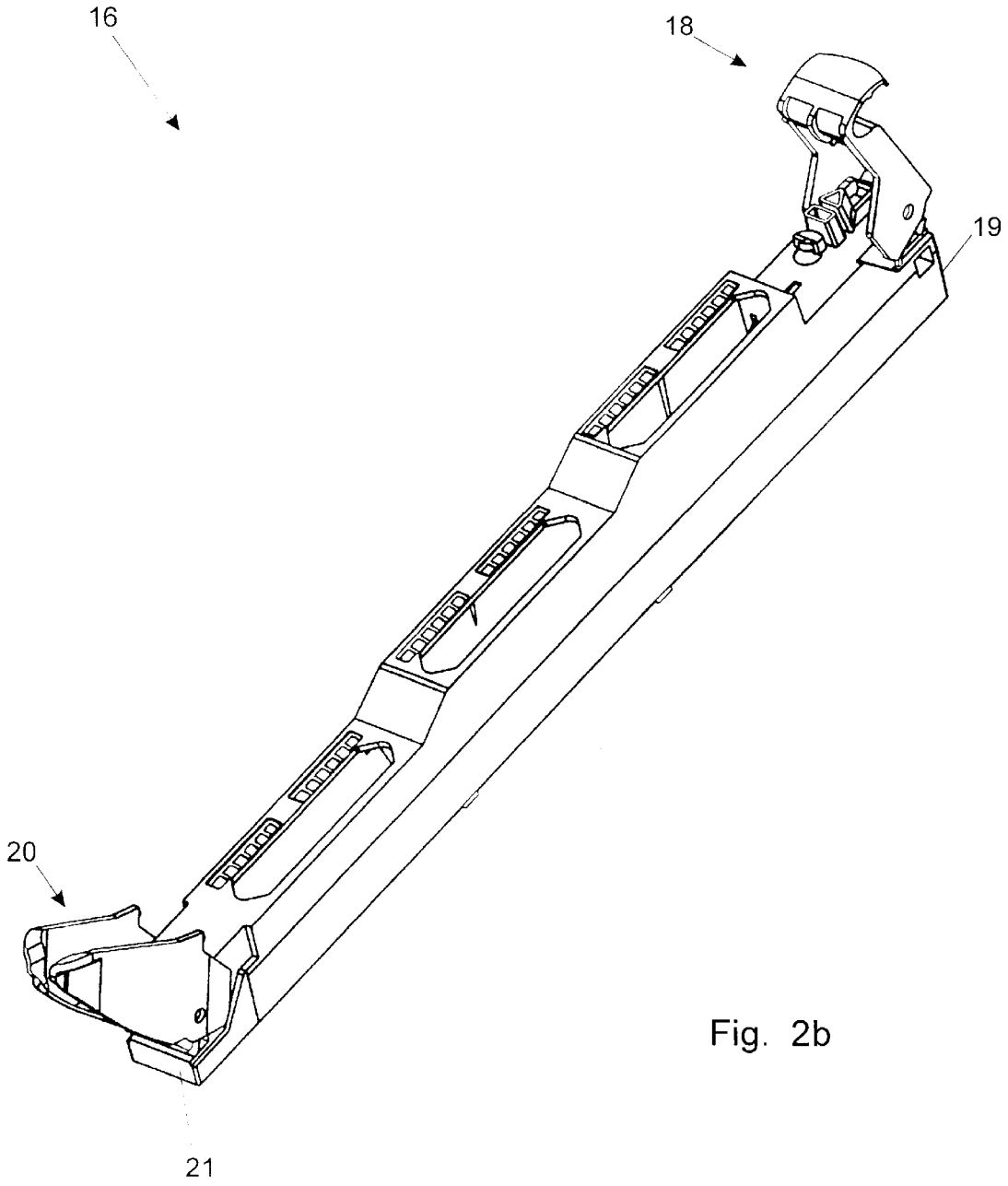
FIG. 2*b* is a perspective view of the faceplate of FIG. 2*b* with the LCM and the latch in the open position.
Figure 2C:
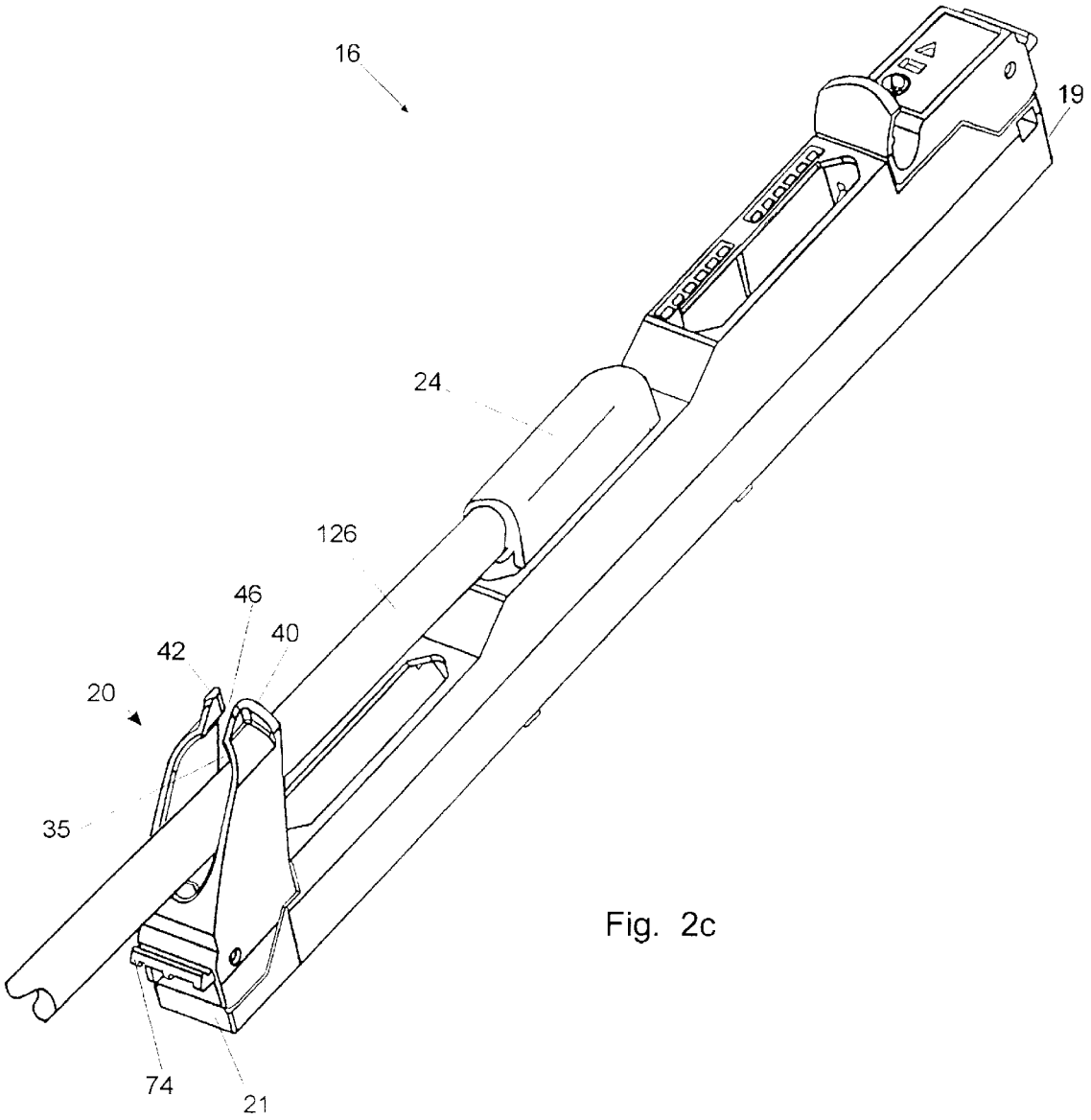
FIG. 2*c* is a perspective view of the faceplate of FIG. 2*a*, with a larger LCM, and a cable contained within the LCM.

From the open and unlocked position shown in FIG. 2*b*, the user is able to grasp the LCM 20 and the latch 18 with his or her fingers and pull the module out of the cabinet 10.

The LCM 20 (and the latch 18) in combination with the faceplate 16 are designed to assist the user appreciate when the LCM 20 is near either the fully open or the fully closed position to help the user avoid attempting to over-rotate the LCM 20. For example, preferably, when the LCM 20 is being rotated towards the closed position shown in FIG. 2*a*, just before LCM 20 is in the closed position, the projections 120 of the faceplate 16 will pass over detents 94 of the LCM 20 prior to the projections 120 being inserted into indentations 92 of the LCM 20. The user should be able to feel the resistance caused by the projections 120 passing over detents 94, thereby alerting the user to the fact that the LCM 20 is near the fully closed position. Once the projections 120 are moved within the indentations 92, the detent portions 94 should prevent inadvertent rotation of the LCM 20 from the fully closed position.

The securing bar 74 of the LCM 20 is preferably designed such that as the LCM 20 is rotated from the closed position to the open position, the outermost surface 77 of the securing bar 74 rubs against lower surface 123 of the faceplate 16. This resistance alerts the user that the LCM 20 has been sufficiently rotated so that the securing bar 74 is no longer locked against the flanges (not shown) of the cabinet 10 and therefore the module can be removed from the cabinet 10. This resistance also informs the user that the LCM 20 is near its fully open position and therefore helps the user avoid over-rotating the LCM 20.

In the fully open position, the support ridges 90 on the under-surface of the securing bar 74 contact stop wall 125 of the faceplate 16. In this position, the upward force of the lower surface 123 against the outermost surface 77 of the securing bar 74 thereby creates a corresponding downward force of the pivot projections 122 of the faceplate 16 against pivot holes 100 of the LCM 20. The LCM 20 is therefore held in the open position against inadvertent rotation until the LCM 20 is rotated towards the closed position with sufficient force to overcome the opposing forces of the lower surface 123 and the projections 122 against the LCM 20.

Typically, a particular faceplate is designed to accommodate up to a maximum number of cable connectors connected to cables of a particular gauge. Accordingly, it is possible to determine a preferred size or area of gap 35 of the LCM 20 to accommodate a maximum number of cables of a particular gauge. Similarly, it is possible to determine a preferred width of entrance/exit 46 of the LCM 20 to allow entrance or exit of cables of a particular gauge. However, if necessary, an LCM having a gap 35 of a particular area or having an entrance/exit 46 of particular width can be replaced by an LCM having a gap 35 of different area or having an entrance/exit 46 of different width.

In order to remove an LCM from the faceplate 16, the lower portions of walls 32, 34 of the LCM 20 are manually forced apart until the pivot projections 122 of the faceplate 16 are disengaged from pivot holes 100 of the LCM 20. The LCM 20 can then be lifted upwards as pivot indentations 122 of the faceplate 16 slide along depressions 98 of the LCM 20 until the LCM 20 has been lifted clear of the faceplate 16.

To fit a new LCM onto the faceplate 16, the depressions 98 of the LCM 20 are placed adjacent to the pivot indentations 122 of the faceplate 16. The LCM 16 is then pushed downwardly, thereby causing the pivot indentations 122 of the faceplate 16 to slide along the depressions 98 of the LCM 20 until the pivot indentations of the faceplate 16 "snap" into pivot holes 100 of the LCM 16, thereby securing the LCM 20 to the faceplate 16.

As an example of LCMs of different size, as noted above, the LCM 20 shown in FIG. 2*c* has a gap 35 of larger area than the gap 35 of LCM 20 shown in FIG. 2*a*. The gap 35 of FIG. 2*c* is of larger area than the gap 35 of FIG. 2*a* because the fingers 36, 38 of the LCM 20 of FIG. 2*c* are longer than those of FIG. 2*a*. Where there are more cables or cables of larger gauge, it is preferable to have a gap 35 of larger area.

Numerous modifications and variations of the present invention are possible in light of the above teachings. It is therefore to be understood that within the scope of the appended claims, the invention may be practised otherwise than as specifically described herein. For example, there are many techniques for pivotally connecting the LCM 20 to the faceplate 16 including the use of a rod (not shown) through pivot holes 100 of the LCM 16 or by hingedly connecting the LCM 20 the faceplate 16. As another example, the gap 35 of the LCM 20 could instead be defined by a clip or elastic band (not shown) biased against a single arm (not shown) of the LCM 20.

We claim:

1. An elongate faceplate for a circuit module receivable within a cabinet, the faceplate having a longitudinal axis, at least one aperture for receiving a first connector mounted on the module which connector is mateable with a second connector connected to a cable, the faceplate having at one longitudinal end a latch member engageable with a part of the cabinet to latch the faceplate to the cabinet, the faceplate having at the other longitudinal end a latch/cable management unit (LCM) and an LCM end surface perpendicular to the longitudinal axis of the faceplate, the LCM comprising:

a cable containment means for containing the cable connected to the second connector; and an integral latching member engageable with a part of the cabinet, the LCM being pivotably mounted about an axis perpendicular to the longitudinal axis such that when the LCM is manually pivoted from a relatively open position to a relatively closed position the integral latching member latches to the cabinet.

2. The faceplate of claim 1 wherein the containment means move towards the latch member as the LCM is pivoted from the open position to the closed position and the containment means move away from the latch member as the LCM is pivoted from the closed position to the open position.

3. The faceplate of claim 1 wherein the integral latch member comprises a bar portion projecting generally outwardly from the LCM and wherein when the LCM is in the closed position, the bar portion projects beyond the LCM end surface of the faceplate to latch the LCM to the cabinet and when the LCM is in the open position, the bar portion does not project beyond the LCM end surface of the faceplate.

4. The faceplate of claim 1 wherein the containment means comprise arm portions defining a gap for containing and guiding the cable connected to the second connector, the arm portions further defining an entrance/exit for the cable to or from the gap, the gap being adapted for guiding the cable parallel to the longitudinal axis of the faceplate.

5. The faceplate of claim 4 wherein the arm portions extend upwardly from a lower portion of the LCM and the entrance/exit is located at upper ends of the arm portions.

6. The faceplate of claim 5 wherein the LCM further comprises a grasping means for enabling the user to grasp the LCM to pull or push the faceplate in or out of a cabinet.

7. The faceplate of claim 6 wherein the grasping means comprise the arm portions.

8. The faceplate of claim 1 wherein the LCM further comprises holding means for holding the LCM in the open position and the LCM additionally comprises holding means for holding the LCM in the closed position.

9. The faceplate of claim 8 wherein the holding means for holding the LCM in the open position comprise an indentation formed within a surface of the LCM for engagement with a projection from the faceplate.

10. The faceplate of claim 8 wherein the holding means for holding the LCM in the closed position comprise:

a hole formed within the LCM for pivotally connecting the LCM to the faceplate, and an outer surface of the integral latching member wherein when the LCM is in the open position, a projection of the faceplate for pivotal engagement with the hole of the LCM creates a force in one direction on the LCM and a surface of the faceplate in contact with the outer surface of the integral latching member creates a force in a direction generally opposite to the force created by the projection on the LCM, thereby holding the LCM in the open position.

11. A latch/cable management unit (LCM) for use with an elongate faceplate of a circuit module, the circuit module being receivable within a cabinet, the faceplate having a longitudinal axis, at least one aperture for receiving a first connector mounted on the module which first connector is mateable with a second connector connected to a cable, the faceplate having at one longitudinal end an LCM end surface perpendicular to the longitudinal axis, the LCM comprising:

a cable containment means for containing a cable connected to the second connector; and an integral latching member the LCM being pivotably engageable to the faceplate adjacent the LCM end surface of the faceplate, the LCM being pivotable about an axis perpendicular to the longitudinal axis such that when the LCM is engaged to the faceplate, when the LCM is manually pivoted from a relatively open position to a relatively closed position, the integral latching member latches to the cabinet.

12. The LCM of claim 11 wherein, when the LCM is engaged with the faceplate, the containment means move towards a longitudinal end of the faceplate opposite the LCM end surface as the LCM is pivoted from the open position to the closed position and the containment means move away from the longitudinal end of the faceplate opposite the LCM end surface as the LCM is pivoted from the closed position to the open position.

13. The LCM of claim 11 wherein, when the LCM is engaged with a faceplate, the integral latching member comprises a bar portion projecting generally outwardly from the LCM and wherein when the LCM is in the closed position, the bar portion projects beyond the LCM end surface of the faceplate to latch to LCM to a cabinet and when the LCM is in the open position, the bar portion does not project beyond the LCM end surface of the faceplate.

14. The LCM of claim 11 wherein the containment means comprise arm portions defining a gap adapted for containing and guiding a cable connected to a second connector when the LCM is engaged with the faceplate, the arm portions further defining an entrance/exit for the cable to or from the gap, the gap being adapted for guiding the cable parallel to the longitudinal axis of the faceplate.

15. The LCM of claim 14 wherein the arm portions extend upwardly from a lower portion of the LCM and the entrance/exit is located at upper ends of the arm portions.

16. The LCM of claim 15 wherein the LCM further comprises a grasping means for enabling the user to grasp the LCM to pull or push the faceplate in or out of a cabinet, when the LCM is engaged with the faceplate.

17. The LCM of claim 16 wherein the grasping means comprise the arm portions.

18. The LCM of claim 11 wherein the LCM further comprises holding means for holding the LCM in the open position when the LCM is engaged with the faceplate and the LCM additionally comprises holding means for holding the LCM in the closed position when the LCM is engaged with the faceplate.

19. The LCM of claim 18 wherein the holding means for holding the LCM in the open position comprise an indentation formed within a surface of the LCM for engagement with a projection from the faceplate.

20. The LCM of claim 18 wherein the holding means for holding the LCM in the closed position comprise a hole formed within the LCM for pivotally connecting the LCM to the faceplate, and an outer surface of the integral latching member wherein when the LCM is engaged with the faceplate and the LCM is in the open position, a projection of the faceplate for pivotal engagement with the hole of the LCM creates a force in one direction on the LCM and a surface of the faceplate in contact with the outer surface of the integral latching member creates a force in a direction generally opposite to the force created by the projection on the LCM, thereby holding the LCM in the open position.

* * * * *